US007000455B2

(12) United States Patent
Stritzelberger

(10) Patent No.: US 7,000,455 B2
(45) Date of Patent: Feb. 21, 2006

(54) LEAKAGE MONITORING IN THE HYDRAULIC PRESSURE AREA OF A MEMBRANE PUMP

(75) Inventor: Michael Stritzelberger, Weil der Stadt (DE)

(73) Assignee: LEWA Herbert Ott GmbH + Co. KG, Leonberg (DE)

( * ) Notice: Subject to any disclaimer, the term of this patent is extended or adjusted under 35 U.S.C. 154(b) by 70 days.

(21) Appl. No.: 10/845,075

(22) Filed: May 14, 2004

(65) Prior Publication Data

US 2004/0226344 A1 Nov. 18, 2004

(30) Foreign Application Priority Data

May 16, 2003 (DE) ..... 103 22 221

(51) Int. Cl.
*G01M 3/04* (2006.01)
*F04B 49/00* (2006.01)

(52) U.S. Cl. ..... 73/40; 417/63; 92/5 R

(58) Field of Classification Search ..... 73/47, 73/49.7, 40, 46; 417/63; 92/5 R, 86
See application file for complete search history.

(56) References Cited

U.S. PATENT DOCUMENTS 3,587,405 A * 6/1971 Holmes ..... 92/5 R
4,904,028 A * 2/1990 Leiber et al. ..... 303/113.3
4,966,528 A * 10/1990 Henkel et al. ..... 417/63
5,047,950 A * 9/1991 Fritsch et al. ..... 702/47
5,303,641 A * 4/1994 Gallandere ..... 100/35
5,655,894 A * 8/1997 Fritsch ..... 417/387
5,979,160 A * 11/1999 Yashiki et al. ..... 60/276
6,116,391 A * 9/2000 Kremmling et al. ..... 192/3.58
6,131,448 A * 10/2000 Hyodo et al. ..... 73/118.1
6,209,315 B1 * 4/2001 Weigl ..... 60/274
6,523,398 B1 * 2/2003 Hanai et al. ..... 73/118.1
6,554,578 B1 * 4/2003 Siegel ..... 417/53
6,767,189 B1 * 7/2004 Kleibrink ..... 417/53
2003/0049145 A1 3/2003 Kohlhase et al.

FOREIGN PATENT DOCUMENTS

DE 198 26 610 12/1999
EP 0 328 143 8/1989
JP 357823 * 3/1991
JP 2003-106221 A * 4/2003

* cited by examiner

*Primary Examiner*—Michael Cygan
(74) *Attorney, Agent, or Firm*—Jacobson Holman PLLC

(57) ABSTRACT

In a process for the monitoring of leakage in the hydraulic pressure area of a membrane pump, processing is in a manner such that the point in time ($t_3$), at which the snifting process serving for leakage compensation is initiated, is monitored continuously and compared with a reference value ($t_1$), where a predetermined deviation ($\Delta t_1 - t_3$) between two values ($t_3$ and/or $t_1$) triggers a leakage display.

5 Claims, 2 Drawing Sheets

LEAKAGE MONITORING IN THE HYDRAULIC PRESSURE AREA OF A MEMBRANE PUMP

FIELD OF THE INVENTION

The invention relates to a process for the monitoring of leakage in the hydraulic pressure area of a membrane pump.

BACKGROUND OF THE INVENTION

The proper function of all the components and structural parts in the hydraulic pressure area of an, in particular hydraulically driven, membrane pump has a decisive effect on the displacement as well as on the dosing precision of such a pump.

Other structural parts of the membrane pump, such as the leakage compensation valve as well as the pressure-limiting valve, are liquid-tight in new condition and have no leakage.

In contradistinction thereto, the piston sealing is not liquid-tight even in new condition. Thus, depending on the embodiment of the sealing, the hydraulic fluid, and the operating parameters such as pressure, temperature, etc., there is in operation always a certain leakage which is then filled once again in the rear dead point of the piston, i.e. at the end of the intake stroke, by the leakage compensation valve.

Even if a gas discharge valve is customarily installed on the membrane pump, a certain leakage results in this valve. Moreover, all of said structural parts of the membrane pump are subjected to a certain wear in operation. This likewise makes itself noticeable by an increased leakage which has a disadvantageous effect on the displacement as well as on the dosing precision. Also an undesired increase in leakage can occur due to the failure of a seal, in particular in the area of the pump piston.

In practice, it has been previously attempted to address this problem by promptly exchanging, based on experience, the structural parts in question, which are subject to wear. Despite this, it happens relatively frequently that structural parts fail prematurely and thus cause undesirable subsequent damage which is undesirable due to the necessary interruption of operation.

In order to determine any leakage occurring in the hydraulic pressure area of the membrane pump, it has been attempted previously to make this known promptly via the pump's deficiency in displacement which occurs or by means of temperature measurement. These processes have, however, not proven themselves effective since they either are associated with too great an expense in construction or do not produce the desired results.

SUMMARY OF THE INVENTION

Thus, the invention is based on the objective of providing, for the elimination of the disadvantages described, a process of the generic type by means of which it is possible to recognize promptly increases in leakage in the hydraulic pressure area of the membrane pump so that any interruption in operation which may possibly be required can be planned promptly.

The invention is based on the essential idea that the point in time or the crank angle is monitored at which the snifting process, which sets in at the end of the intake stroke, is initiated. In case of a predetermined change in the point in time or the crank angle, this is displayed immediately.

In the process according to the invention it is thus provided in detail that the point in time at which the snifting process, serving for leakage compensation is initiated, is monitored continuously and compared to a reference value, where a predetermined deviation between the two values triggers a leakage display.

In an embodiment according to the invention, the crank angle of the pump drive mechanism can be monitored to monitor the beginning of the snifting process as a function of time.

Advantageously, the beginning and end of the snifting process are recorded by monitoring an absolute pressure value.

Particularly clear results can be achieved when the absolute pressure value is monitored for the change of its pressure gradient. In this case it lies within the scope of the invention that the change of the pressure gradient is recorded per unit of time or per degree of the crank angle and that a leakage display is only triggered in case of an overshoot of a predetermined value.

As is known, the point in time of the beginning of the snifting process makes itself noticeable with a lowering of the pressure in the intake stroke to the initial pressure of the leakage valve. In this case, in an intact pump, the resulting snifting window, i.e. the period of time between the beginning and end of snifting process, is very narrow but becomes significantly broader, i.e. longer in time, with increasing leakage in the hydraulic pressure area due to defective structural components.

The beginning and end of the snifting process can, merely by way of example, be recorded by absolute pressure values being monitored. For this purpose, for example, absolute pressure values of 1.5 bar are used. If this value is overshot, this is a sign of the beginning of the snifting process. If this value is once again undershot, the snifting process has ended.

The absolute pressure value at which the snifting process begins depends on the construction of the membrane pump and can also assume values under 1 bar absolute.

The beginning and end of the snifting process express themselves in very steep pressure reductions or pressure increases. In this case, processing according to the invention can, as already mentioned, be done in such a manner that the pressure is monitored for sharp changes in pressure. Thus, it is possible to evaluate a lowering of the pressure to below the limiting value of, e.g. 1.5 bar, as the beginning of the snifting process only when the change in pressure per unit of time or per crank angle degree simultaneously overshoots a certain value. This then triggers the leakage display.

A further embodiment possibility consists of no fixed limiting value of, e.g. 1.5 bar, being predefined but rather the pressure value being determined by the recorded pressure value being averaged at the beginning of the intake stroke in the time window $t_4$–$t_5$ (See FIG. 2*a*) and serving as reference. The limiting value can then follow from the pressure value p45 less a differential pressure to be determined of, for example, 0.2 bar.

These and other objects of the invention, as well as many of the intended advantages thereof, will become more readily apparent when reference is made to the following description taken in conjunction with the accompanying drawings.

BRIEF DESCRIPTION OF THE DRAWINGS

The invention will be explained in more detail in the following with the aid of the drawings. These show in.

DETAILED DESCRIPTION OF THE PREFERRED EMBODIMENTS

Figure 1:
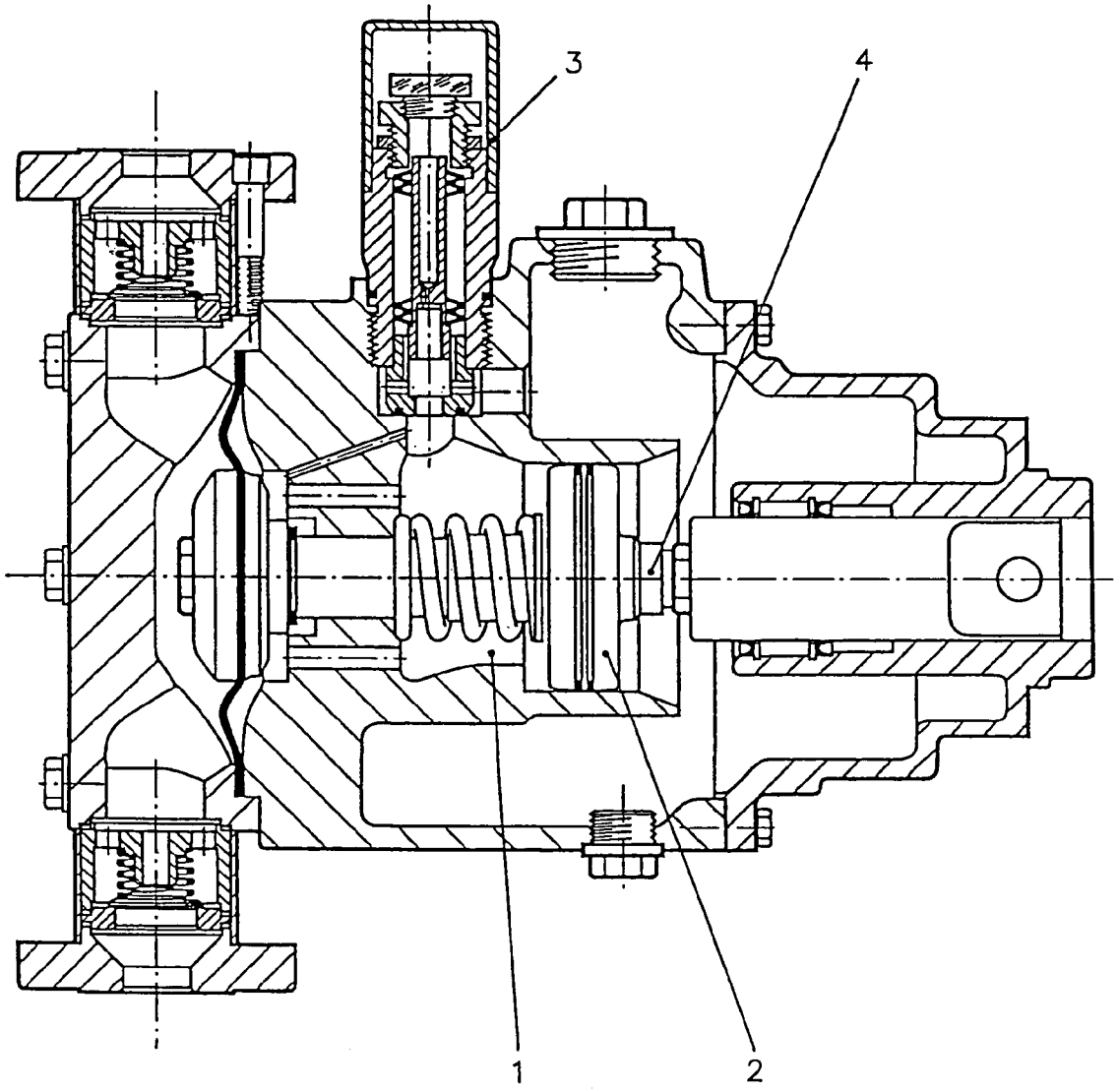
FIG. 1 illustrates schematically in section a membrane pump in whose hydraulic pressure area the process according to the invention for the monitoring of leakage is applied, FIG. 2*a* diagrams the pressure curve as a function of time during the pressure stroke and intake stroke of the pump with a curve as a function of time of the snifting window for an intact pump, and FIG. 2*b* includes a curve as a function of time of the snifting window in the case of increased hydraulic leakage.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

FIG. 1 shows in section a customary membrane pump whose more detailed description can be omitted because it is known, for example, from U.S. Patent Application Publication No. 2003/0049145, hereby incorporated in its entirety by reference. In the present case however, it is a matter of monitoring the leakage occurring in the hydraulic pressure area 1 of the pump by continuously monitoring and comparing to a reference value the point in time at which the snifting process serving for leakage compensation is initiated, where a predefined deviation between both values triggers a leakage display.

Leaks of this type can, as mentioned, occur at the piston sealing 2, at the pressure-limiting valve 3, or at the leakage compensation valve, not represented in more detail.

Figure 2A:
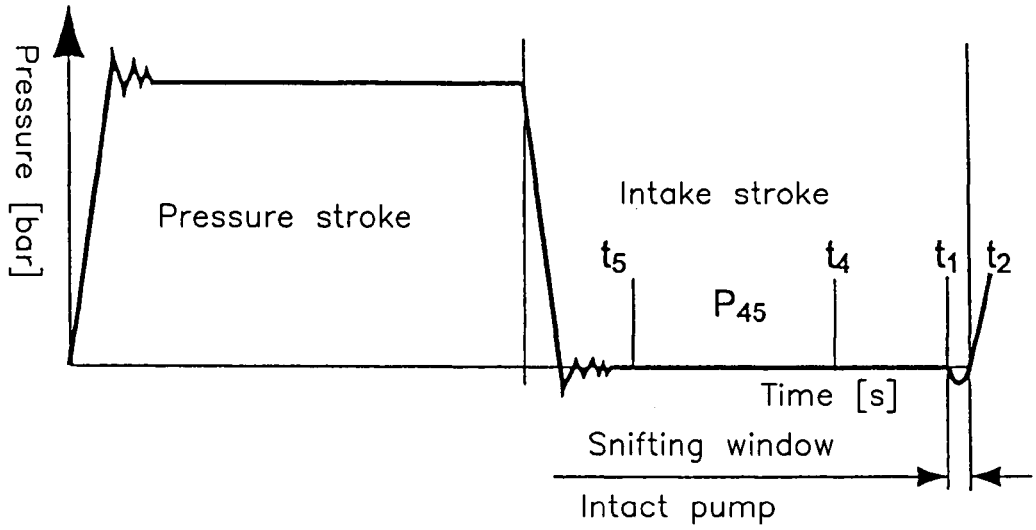

In FIG. 2*a* is represented the typical pressure curve in the hydraulic pressure area 1 during a stroke cycle of the membrane dosing pump. Therein it is shown that at the end of the intake stroke, if the pump piston 4 is located at the rear dead point, the actual snifting process begins, which serves for leakage compensation in the hydraulic pressure area 1. In this case, for an intact pump, the snifting process begins at the point in time $t_1$ and ends at the point in time $t_2$.

Figure 2B:
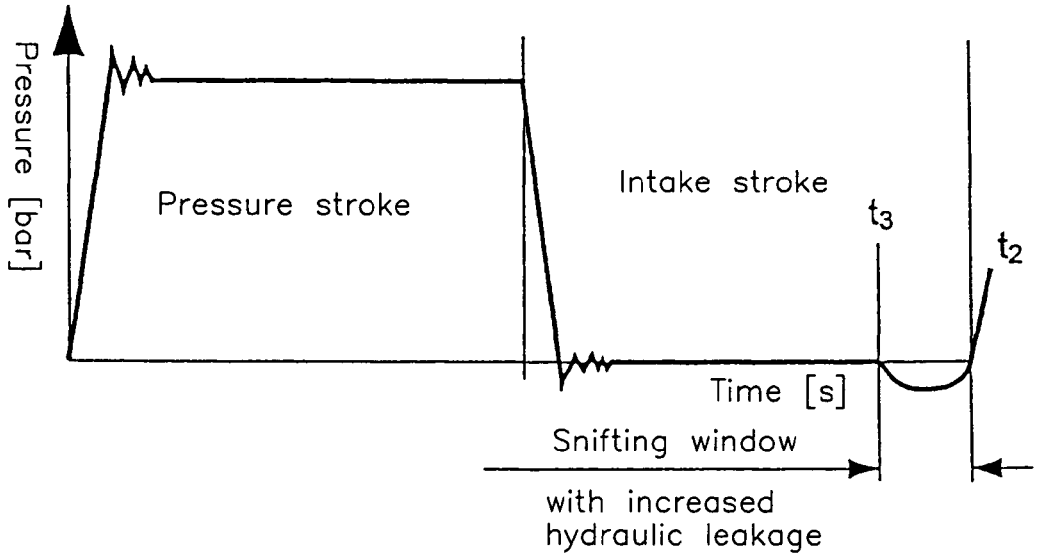

If, on the contrary, an increased hydraulic leakage in the hydraulic pressure area 1 occurs or has occurred, the snifting process begins at the point in time $t_3$, as represented in FIG. 2*b*. This value $t_3$ deviating from the value $t_1$ then triggers a leakage display if the deviation between the two values overshoots a predefined value.

The point in time $t_1$ can be predefined and recorded in different ways.

1.) Through a reference measurement on the intact pump,

2.) Through a selection from predefined values, for example, from a matrix with defined values for different pump embodiments and operating conditions, 3.) Through a computational determination from pump and operating data such as displacement pressure, pump speed of rotation, type and temperature of hydraulic fluid. For this, it can be advantageous to continuously record the operating pressure, the pump speed of rotation, and the temperature of hydraulic fluid.

The methods according to numbers 1.) and 3.) can be combined in an advantageous manner by a reference value being determined in operation and changes being determined by computation.

Method 3.) or the combination of 1.) and 3.) can be applied to particular advantage in the case of changing operating conditions since the time period of the snifting process in practical operation can change without a fault being present.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. Process for the monitoring of leakage in a hydraulic pressure area of a membrane pump, said process comprising the steps of continuously monitoring a point in time at which a snifting process serving for leakage compensation is initiated, and comparing the monitored point in time with a reference value, where a predetermined deviation between the monitored point in time and the reference value triggers a leakage display.

2. Process according to claim 1, wherein a crank angle of a pump drive mechanism is monitored continuously to monitor the point in time of the beginning of the snifting process.

3. Process according to claim 1, wherein a beginning and an end of the snifting process are recorded by monitoring an absolute pressure value in the hydraulic pressure area.

4. Process according to claim 3, wherein the absolute pressure value is monitored for a change of a pressure gradient.

5. Process according to claim 4, wherein the change of the pressure gradient is recorded per unit of time or per degree of the crank angle and the leakage display is only triggered in case of an overshoot of a predetermined value.

* * * * *